United States Patent [19]

Armour et al.

[11] 3,966,563

[45] June 29, 1976

[54] COKE GUIDE SPRAY SYSTEM

[75] Inventors: Frank K. Armour, Flossmoor; Robert P. Winters, Olympia Fields, both of Ill.

[73] Assignee: Interlake, Inc., Chicago, Ill.

[22] Filed: Sept. 27, 1973

[21] Appl. No.: 401,188

[52] U.S. Cl. ..... 202/228; 202/230; 202/263; 201/39

[51] Int. Cl.[2] ..... C10B 39/02; C10B 27/04; C10B 39/12

[58] Field of Search ..... 202/227, 228, 229, 230, 202/262, 263; 201/39; 55/259

[56] References Cited

UNITED STATES PATENTS

| | | | |
|---|---|---|---|
| 982,590 | 1/1911 | Goodall | 202/227 |
| 3,183,645 | 5/1965 | Yeller | 55/259 |
| 3,367,844 | 2/1968 | Cremer | 202/227 |
| 3,626,672 | 12/1971 | Burbidge | 55/259 |
| 3,676,305 | 7/1972 | Cremer | 202/263 |
| 3,721,609 | 3/1973 | Spindeler | 202/263 |
| 3,766,018 | 10/1973 | Riechert | 202/227 |

*Primary Examiner*—Jack Sofer
*Attorney, Agent, or Firm*—Prangley, Dithmar, Vogel, Sandler & Stotland

[57] ABSTRACT

A coke guide spray system on a coke guide disposed on a track between a row of coke side doors and a coke quenching car, the coke guide including an outer frame mounted on wheels for movement along a coke guide track and mounting on the outer frame a track carrying a coke guide chute provided with wheels engaging the track for movement toward and away from an associated coke side door, a water inlet pipe mounted on the outer frame and connected to a source of water under pressure, a first water spray mounted on the outer frame above the coke guide chute adjacent to the end thereof disposed toward the associated coke quenching car, and a second water spray mounted on the outer frame above the coke guide chute and disposed outwardly with respect to the end thereof disposed toward the associated coke quenching car; another system is provided with a hood housing, an induced draft fan and a condensing spray system, while yet another system is provided with a hood having a mist eliminator tower housing a spray condensing system and a grit filter.

3 Claims, 3 Drawing Figures

341
342
372
12
370
10
375
340
12
371
332
14
350
11
353
300
15
361
355
330
360
365
362
352
326
311
325
333
322
310
354
321
331
307
320
306
358
305
308
21
20
24
35
359
351
30
33
23
34
40
36
22
32
31
41

COKE GUIDE SPRAY SYSTEM

BACKGROUND OF THE INVENTION

The present invention relates generally to improvements in coke guides, and specifically to the provision of spray systems thereon to minimize emission therefrom during the discharge of coke from a coking oven through the coke guide into a coke quenching car.

Standard coking practice heretofore has discharged coke from an oven by pushing the coke through the coke side door where it enters a coke guide that guides the hot charge of coke into a quenching car that holds the charge from one oven. The quenching car travels to a quenching station where overhead nozzles spray water into the car to lower the temperature of the hot coke in the car. After draining, the quenching car is moved to a coke wharf where the coke is dumped from the bottom of the car into conveyors which take it to a crushing and screening plant.

During the movement of the hot coke through the coke side door and the coke guide into the quenching car, there has heretofore been a discharge of gases and particulate matter into the atmosphere, which discharge is deleterious to the environment and generally undesirable.

SUMMARY OF THE INVENTION

The present invention provides a coke guide spray system which permits discharge of the hot coke from the coke side door through the coke guide and into the coke quenching car with a minimum of discharge of noxious gases and particulate matter into the atmosphere.

This is accomplished in the present invention, and it is an object of the present invention to accomplish these desired results, by providing a coke guide spray system mounted on a coke guide that includes an outer frame mounted on a coke guide track for movement of the coke guide upon the coke guide track from one coke side door to another along a battery of coke ovens, a track mounted on the outer frame and arranged transversely with respect to the coke guide track, a coke guide chute mounted on the transverse track for movement toward and away from an associated coke side door, a water inlet pipe mounted on the coke guide and adapted to be connected to a source of water under pressure, a first water spray mounted on the outer frame upon the coke guide chute adjacent to the end thereof disposed toward the associated coke quenching car for spraying water on the upper surface of the column of coke passing through the coke guide chute, and a second water spray mounted on the outer frame above the coke guide chute and disposed outwardly with respect to the end thereof disposed toward the associated coke quenching car for spraying water on the upper surface of a column of coke as it falls into the associated coke quenching car.

Another object of the invention is to provide a coke guide spray system of the type set forth, wherein a hood is provided surrounding the coke guide chute and extending outwardly therefrom and over an associated coke quenching car to collect any emissions from the coke oven during discharge of hot coke therefrom.

Yet another object of the invention is to provide a coke guide spray system of the type set forth, wherein the coke guide is provided with a hood of the type mentioned, and further is provided with a forced draft fan that draws fumes and particulate matter from the hood and passes them through a water spray, the effluent from the water spray being directed into the coke quenching car.

Still another object of the invention is to provide a coke guide spray system of the type set forth, wherein the hood is provided with a mist eliminator towel incorporating therein a water spray condensing system from which the effluent falls downwardly onto the coke being discharged into the coke quenching car and a grit filter for trapping particulate matter.

Further features of the invention pertain to the particular arrangement of the parts of the coke guide spray systems whereby the above outlined and additional operating features thereof are attained.

The invention, both as to its organization and method of operation, together with further features and advantages thereof will best be understood with reference to the following specification taken in connection with the accompanying drawings.

BRIEF DESCRIPTION OF THE DRAWINGS

Referring to FIG. 1 of the drawings, there is shown a first embodiment of the coke guide spray system as associated with a battery 10 of coke ovens and a coke quenching car 30. As illustrated, the coke oven 10 is provided with the usual roof 11 covering a row of coke ovens, each coke oven being provided with a coal charging port 12 which is sealed during the coking operation. Along the side of the battery of coke ovens are vertically extending buckstays 14 between which are disposed the coke side doors 15 that close the adjacent end of each of the coke ovens in the battery 10 of coke ovens.

Figure 1:
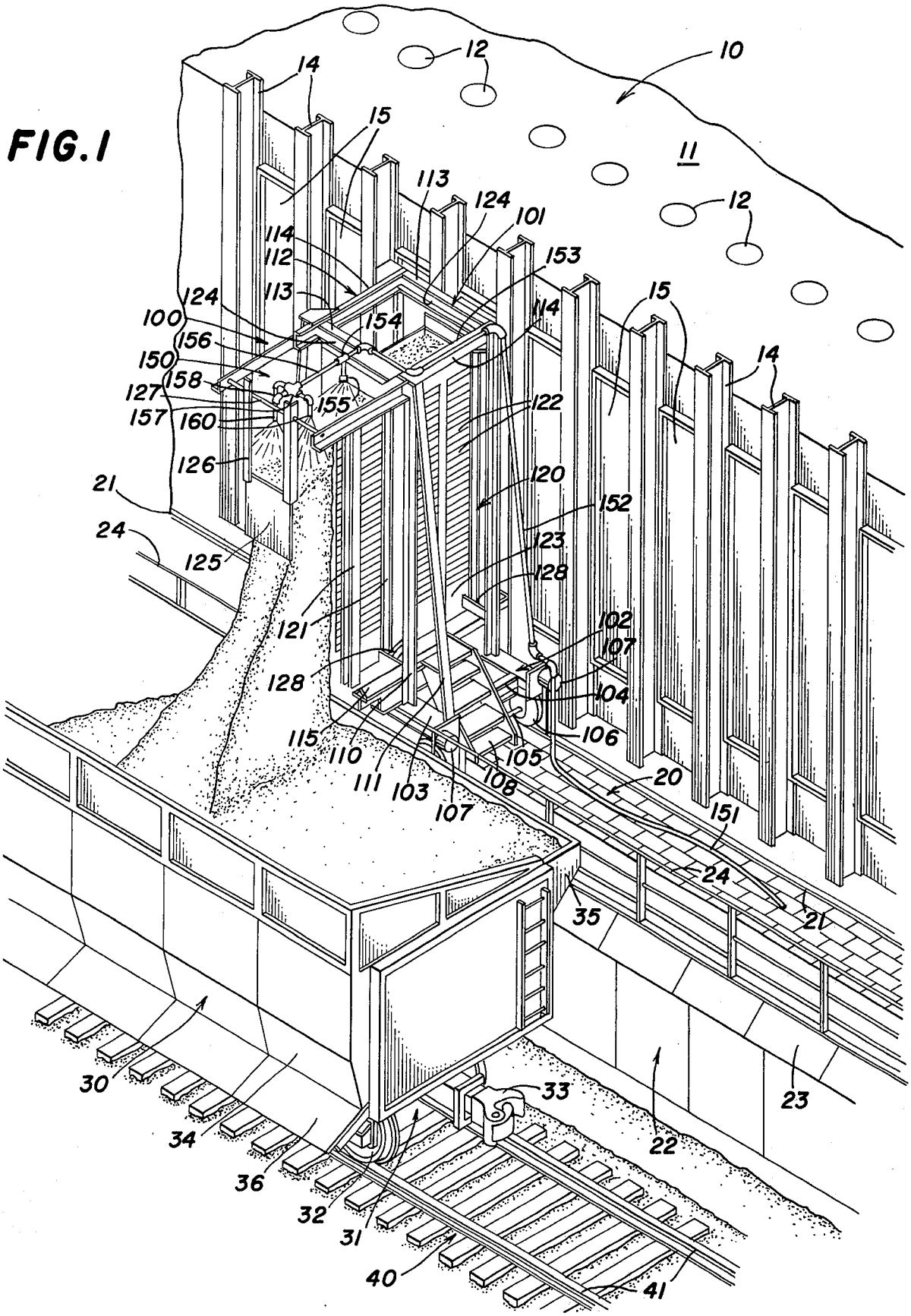
FIG. 1 is a perspective view of a first embodiment of a coke guide spray system made in accordance with and embodying the principles of the present invention, the system being illustrated in operation during the discharge of hot coke from a coke oven into a coke quenching car.

Arranged alongside the coke side doors 15 and disposed therebelow is the usual coke side bench 20 on which are mounted rails 21 providing a coke guide track. Spaced outwardly from the coke side bench is an outer wall 22 including a sloping shield 23, a railing 24 being provided along the coke side bench 20.

Disposed outwardly of the outer wall 22 is the usual quenching track 40 including rails 41 supporting the coke quenching car 30. The car 30 includes trucks 31 having wheels 32 engaging on the rails 41 and a coupler 33 for coupling to an adjacent car or locomotive. The car 30 also includes a body 34 and is illustrated as provided with an overhang 35 to the right and a coke diverter 36 to the left.

A coke guide 100 is mounted upon the rails 21 and includes an outer frame 101 having a lower outer frame 102 and an upper outer frame 112. The lower outer frame 102 includes a pair of spaced-apart longitudinally extending frame members 103 and transverse frame members 104. Mounted on the lower outer frame 102 are two axles 105 carrying wheels 106 engaging the rails 21 to mount the coke guide 100 thereon. Snubbers 107 are also provided on the lower outer frame 102 as are steps 108. Vertical frame members 110 interconnect the lower outer frame 102 and the upper outer frame 112, braces 111 also being provided to rigidify the outer frame 101. The upper outer frame 112 includes longitudinally extending frame members 113 and transverse frame members 114.

Mounted on the lower outer frame 102 are spaced-apart tracks 115 arranged transversely with respect to the coke guide track formed by the rails 21 and generally normal to the associated coke side doors 15. Mounted on the tracks 115 is a coke guide chute 120, the coke guide chute 120 including vertical frame members 121, a plurality of spaced-apart slats 122 thereon, longitudinal frame members 123 and transverse frame members 124. A pair of angle irons 126 are carried by a rod 127 mounted on the coke upper end of the coke guide chute on the side thereof disposed toward the coke quenching car 40, the angle irons 126 carrying a diverting shield 125 that guides the hot coke into the quenching car 40, the diverting shield 125 being pivotal about the rod 127. Also mounted on the coke guide chute 120 are wheels 128 engaging the tracks 115, thereby to permit the entire coke guide chute 120 to be moved with respect to the outer frame 101 toward and away from an associated coke side door 15. More specifically, the coke guide chute 120 is movable between a travel position disposed a substantial distance from the associated coke side doors 15 and a discharge position wherein the coke guide chute 120 is in covering relationship to an opening provided by removing one of the coke side doors 15. Mechanism (not shown) is provided to cause such movement of the coke guide chute 120 and to hold the coke guide chute in the travel position and the discharge position thereof. With the coke guide chute 120 in the travel position, the coke guide 100 can be readily moved from one coke side door 15 to the other and there is room to remove one of the coke side doors 15 to permit discharge of the coke in the associated oven. With the coke guide chute in its discharge position, the end thereof adjacent to the battery of coke ovens 10 is in covering relationship with an opening provided by removing a coke side door 15, the coke guide chute 120 extending from the discharge opening of the associated coke oven across the coke side bench 20 and to and slightly beyond the adjacent side of the quenching car 30, and specifically the overhang 35 thereof.

The spray system 150 includes a hose 151 that is connected to a suitable source of water under essentially constant pressure, such as a municipal water supply. The hose 151 is connected to a vertical pipe 152 mounted on the outer frame 101 of the coke guide 100 and extending to the top thereof where it connects with a transverse pipe 153. A T-junction 154 is provided in the pipe 153 to connect the pipe 153 to an inner spray nozzle 155 that is positioned on the outer frame above the coke guide chute 120 adjacent to the end thereof disposed toward the coke quenching car 30. Preferably the nozzle 155 is arranged essentially in the center of the path of the coke as it flows through the coke guide 100 so that the nozzle 155 can spray water on the upper surface of the column of coke passing through the coke guide chute 120.

Also connected to the T-juncture 154 is a pipe 156 which connects to a union 157 that is in turn connected to three elbows 158 each carrying an outer spray nozzle 160. The outer spray nozzles 160 are in effect mounted on the outer frame 101 and are disposed above the coke guide chute 120 and outwardly with respect to the end thereof disposed toward the coke quenching car 30. The spray nozzles 160 are arranged to spray water on the upper surface of the column of coke as it falls into the coke quenching car 30.

In operation, the coke guide 100 is positioned in the usual manner before the open coke side opening of a coke oven from which the coke side door 15 has been removed. The coke guide chute 120 is moved to the guide position thereof covering the coke side opening. The water supply to the hose 151 is actuated so as to produce spray from the inner spray nozzle 155 and the outer spray nozzles 160. The charge of coke is then pushed in the usual manner from the coke oven and through the coke guide chute 120 and into the coke quenching car 30, the diverting shield 125 serving its usual diverting function.

The spray from the nozzles 155 and 160 serves to quench the upper surface of the column of coke and tends to entrain in the water streams therefrom particulate matter and any noxious fumes that might be present as the hot coke is pushed through the coke guide chute 120 into the coke quenching car 30. As a consequence, emission of noxious fumes and particulate matter into the atmosphere is minimized.

Figure 2:
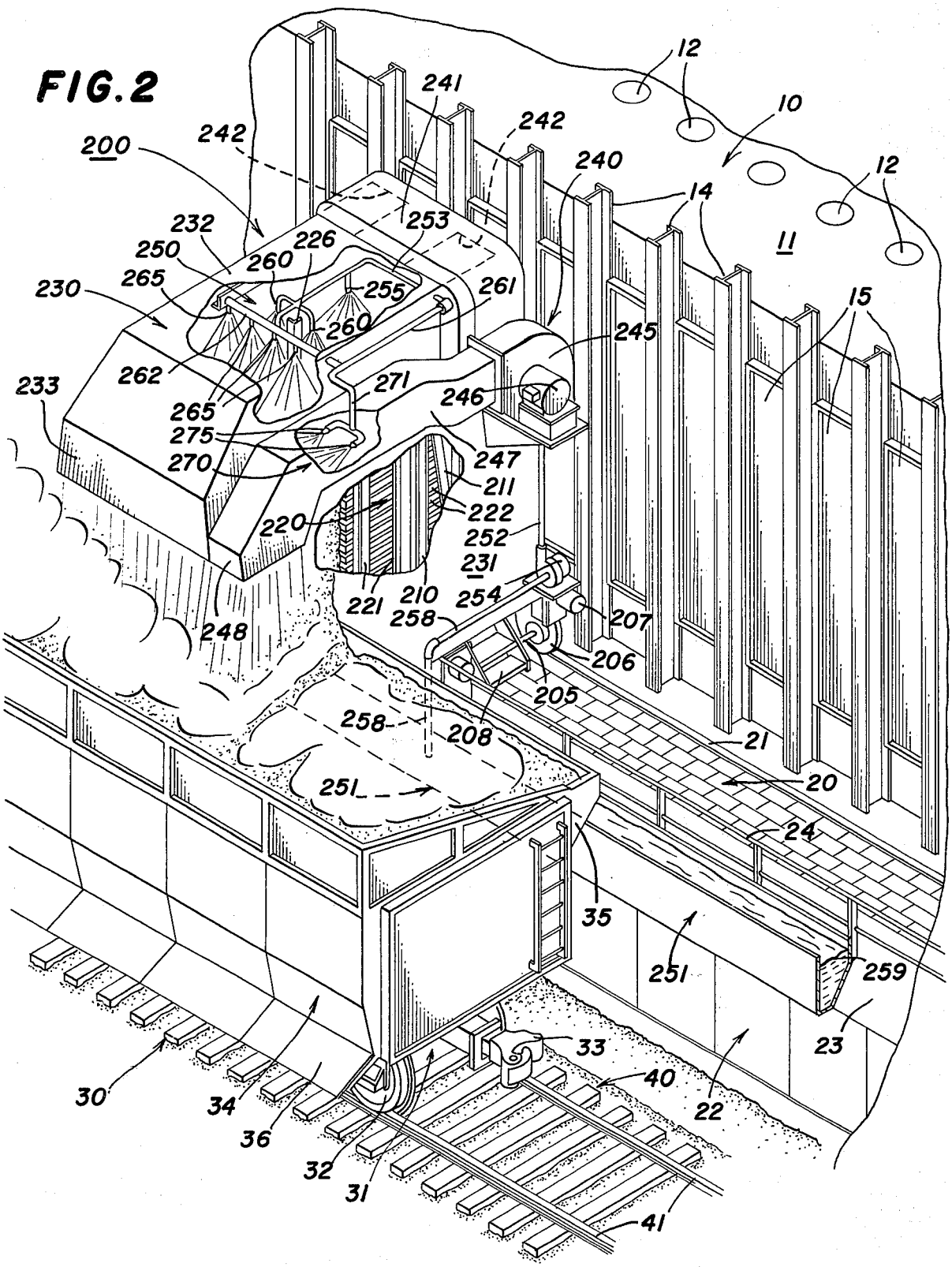
FIG. 2 is a view similar to FIG. 1 and illustrating a second preferred embodiment of the invention incorporating therein a hood over the coke guide, the hood being provided with an induced draft fan and water condensing system.

In FIG. 2 of the drawings there is illustrated a second preferred embodiment of the invention incorporated in a coke guide 200. The same numerals have been applied to the battery 10 of coke ovens and the parts thereof and to the coke side bench 20 and the parts mounted thereon and the coke quenching car 30 and its parts as well as its track 40. Since many of the parts of the coke guide 200 have the same construction and function as like parts in the coke guide 100, like reference numerals in the 200 series have been applied to the parts of the coke guide 200 that correspond to like numbered parts in the coke guide 100 described above.

The coke guide 200 is provided with an outer frame mounted on a pair of axles 205 carrying wheels 206 that ride upon the rails 21. Snubbers 207 and steps 208 are provided as well. Vertical frame members 210 and associated braces 211 are also provided as is a coke guide chute 220 including vertical frame members and slats 222. Visible are the angle irons 226 which support a diverting shield (not shown).

Mounted on the coke guide 200 and essentially enclosing the coke guide chute 220 is a hood 230, the hood 230 including side walls 231, a top wall 232 and a front wall 233 that extends well over the associated coke quenching car 30 and is directed downwardly thereinto. Associated with the hood 230 is an induced draft fan system or exhaust system 240 that includes an inlet duct 241 having inlet openings 242 communicating with the interior of the hood 230 adjacent to the coke side opening in the associated coke oven. There further is provided a fan housing 245 within which is disposed an induced draft fan (not shown) driven by a fan motor 246. The output from the fan is directed into an outlet duct 247 having an exit portion 248 adjacent to the front wall 233 of the hood 230, the exit portion 248 directing the effluent therefrom downwardly into the coke quenching car 30.

Disposed within the hood 230 and on the outer frame of the coke guide 200 is a spray system 250. Water for the spray system 250 is obtained from a water trough 251 that is mounted on the associated sloping portion 23 of the outer wall 21, the trough 251 extending the entire length of the battery 10 and having a water level 259 that is maintained essentially constant from a suitable supply (not shown). Water from the trough 251 is taken through an intake pipe 258 to a water pump 254 mounted on the coke guide 200, which water pump 254 discharges into a vertical pipe 252 on the coke guide 200, the pipe 252 extending upwardly and connecting with a transverse pipe 253 which feeds water to an inner spray nozzle 255 and three outer spray nozzles 260. The inner spray nozzle 255 is positioned within the hood 230 on the outer frame above the coke guide chute 220 adjacent to the end thereof disposed toward the coke quenching car 30, the nozzle 255 being arranged essentially in the center of the path of the hot coke as it flows through the coke guide 200 so that the nozzle 255 can spray water on the upper surface of the column of hot coke passing through the coke guide chute 220. The outer spray nozzles 260 are disposed within the hood above the coke guide chute 220 and outwardly with respect to the end thereof disposed toward the coke quenching car 30, the spray nozzles 260 being arranged to spray water on the upper surface of the column of hot coke as it falls into the coke quenching car 30.

Also connecting with the transverse pipe 253 is a second pipe 261 that carries water to a manifold 262 that feeds four spray nozzles 265 that are spaced outwardly with respect to the spray nozzles 260 and essentially spray water into that portion of the hood 230 overlying the coke quenching car 30, further to absorb any fumes or particulate matter which are released during the falling of coke from the coke guide 200 into the coke quenching car 30.

There also is provided in the outlet duct 246 of the exhaust system 240 a condensing spay system 270, the system 270 including a pipe 271 communicating with the pipe 261 and feeding water to two spray nozzles 275. The spray nozzles 275 direct spray essentially horizontally along the outlet duct 247 and serve to condense fumes and trap and entrain particulate matter that is drawn from the hood 230 through the exhaust system 240, the effluent from the condensing spray system 270 being directed into the coke quenching car 30 by the exit portion 248 of the outlet duct 247.

In operation, the coke guide 200 is positioned in the usual manner before an open coke side opening of a coke oven from which the coke side door 15 has been removed. The coke guide chute 220 is moved to the guide position thereof covering the coke side opening. The pump 254 is energized to draw water from the trough 251 through the intake pipe 258 so as to produce spray from the several spray nozzles 255, 260, 265 and 275. The charge of coke is then pushed in the usual manner from the coke oven and through the coke guide chute 220 and into the coke quenching car 30.

The spray from the nozzles 255 and 260 serve initially to quench the upper surface of the column of coke and entrains in the water streams therefrom any noxious fumes or particulate matter that might be emitted when the hot coke is pushed through the coke guide chute 220. The spray from the nozzles 265 further serve to absorb and entrain fumes and particulate matter that are released as the column of coke falls into the coke quenching car 30 and to deposit the resultant stream of water in the coke quenching car 30. Simultaneously the exhaust system 240 operates to prevent gases and particulate matter from escaping out of the hood 230, all the fumes and particulate material collected by the system being pulled by the fan through the intake duct 241 and the fan housing 245, after which it is passed into the outlet duct 247 and through the condensing spray system 270. All of the gases thus exhausted together with the water from the spray nozzles 275 is discharged from the outlet duct 247 through the exit portion 248 and into the coke quenching car 30. As a consequence, emission of noxious fumes and particulate matter into the atmosphere is essentially eliminated by the operation of the coke guide 200.

Figure 3:
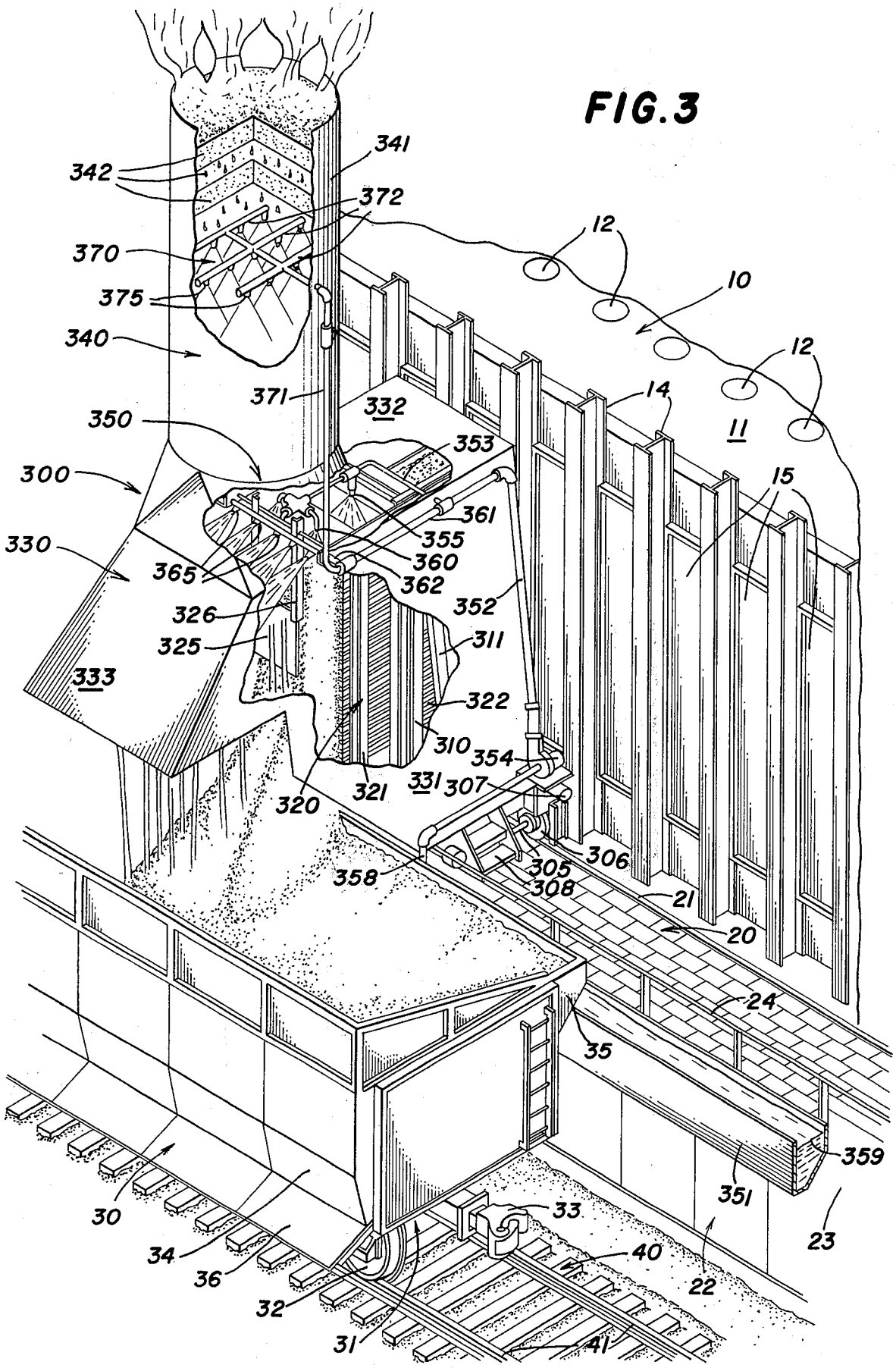
FIG. 3 is a view similar to FIG. 1 and illustrating a third embodiment of the invention, wherein the coke guide is provided with a hood having a quench tower incorporating therein a water spray condensing system and a grit filter.

In FIG. 3 of the drawings there is illustrated a third preferred embodiment of the invention incorporated in a coke guide 300. Since many of the parts of the coke guide 300 have the same construction and function as like parts in the coke guides 100 and 200, like reference numerals in the 300 series have been applied to the parts of the coke guide 300 that correspond to like numbered parts in coke guides 100 and 200 described above. The same reference numerals have been applied to the battery 10 of coke ovens and parts thereof and to the coke side bench 20 and the parts mounted thereon and the coke quenching car 30 and its parts as well as its track 40.

The coke guide 300 is provided with an outer frame mounted on a pair of axles 305 carrying wheels 306 that ride upon the rails 21. Snubbers 307 and steps 308 are provided as well. Vertical frame members 310 and associated braces 311 are also provided as is a coke guide chute 320 including vertical frame members 321 and slats 322. Visible also are the angle irons 326 and the diverting shield 325 supported thereby.

Mounted on the coke guide 300 and essentially enclosing the coke guide chute 320 is a hood 330, the hood 330 including side walls 331, a top wall 332 and a sloping front wall 333 that extends well over the associated coke quenching car 30, there being an opening directed downwardly thereinto from the hood 330. Associated with the hood 330 is an overhead mist eliminator generally designated by the numeral 340 housed in a tower or stack 341 communicating with the interior of the hood 330 at its lower end and venting to the atmosphere at its upper end. Mounted in the stack 341 is a series of grit filters 342 and a condensing spray system generally designated by the numeral 370 which will be described in greater detail hereinafter.

Disposed within the hood 330 and on the outer frame of the coke guide 300 is a spray system 350. Water for the spray system 350 is supplied from a water trough 351 that is mounted on the associated sloping portion 23 of the outer wall 21, the trough 351 extending the entire length of the battery 10 and having a water level 359 that is maintained essentially constant from a suitable supply (not shown). Water from the trough 351 is taken through an intake pipe 358 to a water pump 354 mounted on the coke guide 300, which water pump 354 discharges into a vertical pipe 352 on the coke guide 300, the pipe 352 extending upwardly and connecting with a transverse pipe 353 which feeds water to an inner spray nozzle 355 and three outer spray nozzles 360. The inner spray nozzle 355 is positioned within the hood 330 on the outer frame above the coke guide chute 320 adjacent to the end thereof disposed toward the coke quenching car 30, the nozzle 355 being arranged essentially in the center of the path of the hot coke as it flows through the coke guide 300 so that the nozzle 355 can spray water on the upper surface of the column of hot coke passing through the coke guide chute 320. The outer spray nozzles 360 are disposed within the hood 330 above the coke guide chute 320 and outwardly with respect to the end thereof disposed toward the coke quenching car 30, the spray nozzles 360 being arranged to spray water on the upper surface of the column of hot coke as it falls into the coke quenching car 30.

Also connected with the vertical pipe 352 is a second pipe 361 that carries water to a manifold 362 that feeds five spray nozzles 365 that are spaced outwardly with respect to the spray nozzles 360 and essentially spray water into that portion of the hood 330 overlying the coke quenching car 30, the direction of the spray nozzles 365 being nearly horizontal and toward the sloping front wall 333 of the hood 330 to be diverted thereby downwardly and into the coke quenching car 30. The spray nozzles 365 serve further to absorb any fumes or particulate matter which may be released during the falling of coke from the coke guide 300 into the coke quenching car 30.

As mentioned above, a condensing spray system 370 is also provided in the quenching tower stack 341 immediately below the grit filters 342. To this end the pipe 361 has connected thereto an extension pipe 371 feeding a branched manifold 372 on which are mounted a large number of spray nozzles 375 providing a spray pattern that essentially fills the entire inner area of the stack 341. The spray nozzles 375 therefore serve to create a spray that sweeps the noxious fumes and a large fraction of the particulate matter coming up through the stack 341. The spray from the nozzles 375 and the entrained matter therein is directed downwardly through the stack 341 and the hood 300 onto the falling coke and then into the associated coke quenching car 30. Any particulate matter not entrained in the spray from the nozzles 375 is then removed by the grit filters 342 prior to discharge of the stack gases from the stack 341.

In operation, the coke guide 300 is positioned in the usual manner before an open coke side opening of a coke oven from which the coke side door 15 has been removed. The coke guide chute 320 is moved to the guide position thereof covering the coke side opening. The pump 354 is energized to draw water from the trough 351 through the intake pipe 351 so as to produce spray from the several spray nozzles 355, 360, 365 and 375. The charge of coke is then pushed in the usual manner from the coke oven and through the coke guide chute 320 and into the coke quenching car 30.

The spray from the nozzles 355 and 360 serve initially to quench the upper surface of the column of coke and entrains in the water streams therefrom any noxious fumes or particulate matter that may be emitted when the hot coke is pushed through the coke guide chute 320. The spray from the nozzles 365 further serve to absorb and entrain fumes and particulate matter that are released as the column of coke falls into the coke quenching car 30 and to deposit the resultant stream of water carrying the entrained fumes and particulate matter in the coke quenching car 30. Simultaneously, the overhead mist eliminator 340 in the stack 341 is removing absorbable fumes and particulate matter from the draft rising through the stack 341. More specifically, the spray from the nozzle 375 entrains the absorbable fumes and a large part of the particulate matter in the updraft and washes the same downwardly through the stack 341 and the hood 330 into the coke quenching car 30. Any of the particulate matter escaping the condensing spray system 370 is then further eliminated by means of the grit filters 342, whereby the stack gases issuing from the stack 341 are essentially free of water soluble fumes and particulate matter. As a consequence, emission of noxious fumes and particulate matter into the atmosphere is essentially eliminated by the operation of the coke guide 300.

While there has been described what is at present considered to be the preferred embodiments of the invention, it will be understood that various modifications may be made therein and it is intended to cover in the appended claims all such modifications as fall within the true spirit and scope of the invention.

What is claimed is:

1. A coke guide spray system for use with a battery of coke ovens having a corresponding plurality of coke side doors disposed in a row with a coke guide track arranged generally parallel thereto and with a coke quenching car track arranged beside and generally parallel to the coke guide track and at an elevation therebelow with a coke quenching car thereon and movable therealong, said system comprising a coke guide including an outer frame mounted on the coke guide track for movement of said coke guide from one coke side door to another, a track mounted on said outer frame and arranged transversely with respect to the coke guide track, a coke guide chute mounted on said transverse track for movement toward and away from an associated coke side door, said coke guide guiding coke from an associated open coke side door across the coke guide track and into a coke quenching car on the coke quenching car track, a hood mounted on said coke guide and covering said coke guide chute and extending outwardly over the associated coke quenching car, a water inlet pipe mounted on said coke guide and adapted to be connected to a source of water under pressure, water spray means mounted within said hood above said coke guide chute adjacent to the end thereof disposed toward the associated coke quenching car for spraying water on the upper surface of a column of coke as it falls into the associated coke quenching car and for spraying water into the portion of said hood disposed over the associated coke quenching car, a gas exhaust system mounted on said coke guide and including an intake duct communicating with the interior of said hood and a fan connected to said intake duct and an outlet duct connected to said fan and discharging into said associated coke quenching car, and a horizontally disposed condensing spray system in said outlet duct for spraying a horizontal stream of water therein to entrain fumes and particulate matter passing through said outlet duct and depositing the same in the associated coke quenching car, said hood and said water spray means and said exhaust system and said condensing spray system cooperating to trap emissions from the associated coke oven during discharge thereof in the water from said water spray means and condensing spray system and to direct the water and the emissions trapped therein onto the coke in the coke car and to retain the water therein, whereby to minimize emissions into the atmosphere from the hot coke as it is pushed from an oven through the associated coke side door and said coke guide into the coke quenching car.

2. The coke guide spray system set forth in claim 1, wherein the intake openings for said intake duct are adjacent to the associated coke side opening.

3. The coke guide spray system set forth in claim 1, wherein the outer end of said outlet duct has an exit portion directed downwardly toward an associated coke quenching car, and said condensing spray system directs the spray thereof toward the outlet end of said outlet duct and in the direction of and generally parallel to the flow of gases through said outlet duct.

* * * * *